US008881797B2

(12) United States Patent
Melo et al.

(10) Patent No.: US 8,881,797 B2
(45) Date of Patent: Nov. 11, 2014

(54) COMPACT PLATE-FIN HEAT EXCHANGER UTILIZING AN INTEGRAL HEAT TRANSFER LAYER

(75) Inventors: David M. Melo, Garden City, NY (US); Joseph M. Bacino, Garden City, NY (US); Manu Z. Joseph, Garden City, NY (US)

(73) Assignee: Ametek, Inc., Paoli, PA (US)

( * ) Notice: Subject to any disclaimer, the term of this patent is extended or adjusted under 35 U.S.C. 154(b) by 1136 days.

(21) Appl. No.: 12/774,114

(22) Filed: May 5, 2010

(65) Prior Publication Data

US 2011/0272127 A1 Nov. 10, 2011

(51) Int. Cl.
*F28F 3/04* (2006.01)
*F28D 9/00* (2006.01)

(52) U.S. Cl.
CPC ..... *F28D 9/0062* (2013.01); *Y10S 165/905* (2013.01)
USPC ..... 165/166; 165/179; 165/905

(58) Field of Classification Search
CPC ..... F28D 9/0062; F28F 3/025; F28F 3/044; F28F 3/048
USPC ..... 165/164, 166, 179, 905
See application file for complete search history.

(56) References Cited

U.S. PATENT DOCUMENTS

| | | | | |
|---|---|---|---|---|
| 1,692,391 | A * | 11/1928 | Stancliffe | 165/166 |
| 3,912,003 | A * | 10/1975 | Schrade | 165/166 |
| 4,231,423 | A * | 11/1980 | Haslett | 165/104.14 |
| 4,408,661 | A * | 10/1983 | Eastman et al. | 165/179 |
| 4,559,994 | A | 12/1985 | Waldmann et al. | 165/41 |
| 4,832,118 | A * | 5/1989 | Scanlon et al. | 165/179 |
| 5,318,114 | A | 6/1994 | Sasaki | 165/176 |
| 5,526,873 | A | 6/1996 | Marsais et al. | 165/51 |
| 5,564,496 | A * | 10/1996 | Blum et al. | 165/166 |
| 5,655,600 | A * | 8/1997 | Dewar et al. | 165/166 |
| 6,341,648 | B1 | 1/2002 | Fukuoka et al. | 165/144 |
| 6,460,353 | B2 | 10/2002 | Udobot et al. | 62/86 |
| 7,124,812 | B1 | 10/2006 | Agee et al. | 165/146 |
| 7,188,492 | B2 | 3/2007 | Corduan et al. | 62/640 |
| 7,614,389 | B2 | 11/2009 | Ruckwied | 123/568.12 |
| 7,635,019 | B2 | 12/2009 | Higashiyama | 165/110 |
| 2004/0040153 | A1 | 3/2004 | Ashida et al. | 29/890.03 |
| 2007/0284095 | A1 | 12/2007 | Wang et al. | 165/166 |
| 2008/0085403 | A1 | 4/2008 | Sayir | 428/212 |
| 2010/0051246 | A1 | 3/2010 | Kim et al. | 165/134.1 |

FOREIGN PATENT DOCUMENTS

| | | | | |
|---|---|---|---|---|
| JP | 58055686 A * | 4/1983 | | 165/166 |
| WO | WO 9711329 | 3/1997 | | F28D 9/00 |

OTHER PUBLICATIONS

International Search Report of corresponding application No. PCT/US2011/035285 mailed Dec. 7, 2011.

* cited by examiner

*Primary Examiner* — Leonard R Leo
(74) *Attorney, Agent, or Firm* — Renner Kenner Greive Bobak Taylor & Weber

(57) ABSTRACT

A heat exchanger includes a housing which maintains a first section that has a first inlet and a first outlet, and a second section that has a second inlet and a second outlet. At least one conductive plate extends between the first section and the second section, wherein the conductive plate transfers heat from a fluid flowing in one of the sections to another fluid flowing in the other of the sections. The sections may be positioned side-by-side such that the fluids' flow is coplanar, or co-curvilinear, and non-intersecting.

11 Claims, 7 Drawing Sheets

COMPACT PLATE-FIN HEAT EXCHANGER UTILIZING AN INTEGRAL HEAT TRANSFER LAYER

TECHNICAL FIELD

Generally, the present invention is directed to a plate-fin heat exchanger. Specifically, the invention is directed to a heat exchanger where excess heat of one fluid is absorbed by one plate-fin configuration and transferred by a conductive layer to another co-planar or co-curvilinear plate-fin configuration for absorption by another fluid passing therethrough.

BACKGROUND ART

Compact plate-fin heat exchangers are used to lower the temperature of one fluid by using a second fluid passing in close proximity. Common heat exchangers generally come in three different flow configurations which are illustrated in FIGS. 1A-1C. FIG. 1A illustrates a cross-flow configuration where a fluid is passed through a top plate-fin configuration in one direction while a second fluid is passed through the lower plate-fin configuration in a substantially perpendicular direction. These non-planar intersecting flows allow for the excessive heat in one flow path of a fluid to be transferred to the flow path of the other fluid by conduction of the heat through the plates and fins. FIG. 1B shows a parallel flow configuration where one fluid enters a side of one set of plate-fin configurations while another fluid enters separate interleaved plate-fin configurations that have an entry point oriented at a top edge near the side entry point of the first fluid. The fluids flow in adjacent non-planar parallel paths for a period of time and then exit in a corresponding manner. A thin wall separator maintains the distinct flow paths for each fluid and prevents their intermixing. In any event, the flow paths intersect one another and the heat carried by one of the fluids is transferred to the other fluid by heat conduction through the separating walls. FIG. 1C shows a counterflow configuration which is similar in construction to the parallel flow configuration; however, one of the fluid flows through one set of the plate-fin configurations is reversed. In each of these embodiments, and independent of their use or flow configuration, the compact plate-fin heat exchangers use a relatively thin wall to separate the two fluids to facilitate heat transfer.

As shown in FIGS. 1A-C, and in related prior art devices, a first plate-fin configuration is arranged in a plane and the other plate-fin configuration is adjacently positioned in a parallel plane that overlaps or crosses over the other plate-fin configuration. As noted, the plate-fin layers are only typically separated by a thin wall of material. Accordingly, as a first fluid passes through one plate-fin configuration heat is absorbed by the components thereof and transferred through the separating thin wall to the adjacent plate-fin configuration and absorbed by a second fluid. As such, the overlapping of the different plate-fin configurations and associated chambers facilitates the heat transfer between the two fluids. In order to improve heat transfer from one fluid to the other, the flow paths may include multiple layers as shown in FIGS. 1B and 1C so that they overlap and/or intersect one another. In other words, the layers of the different flow paths are interleaved with one another so as to facilitate the heat transfer process.

Although the aforementioned configurations have been widely adopted and are successful in their stated purpose, it is believed that they also have a number of shortcomings. The thin walls are prone to leakage over time which causes cross-contamination of the fluid materials and which is detrimental to the overall system which associated with the heat exchanger. As such, relatively lower pressures are used to prevent damage to the separator walls. By not being able to use higher pressures, the exchangers have reduced effectiveness in moving the fluids to their intended end use. It is also believed that the size of the known plate-fin heat exchangers can be prohibitive for use in systems with limited space.

Therefore, there is a need in the art for heat exchangers which eliminate cross-contamination between the fluids and which can operate at higher pressures. There is also a need to efficiently transfer heat without any loss in performance, and there is a need to provide these features in a reduced size without sacrificing the effectiveness of the configuration.

SUMMARY OF THE INVENTION

In light of the foregoing, it is a first aspect of the present invention to provide a compact plate-fin heat exchanger utilizing an integral heat transfer layer.

It is another aspect of the present invention to provide a heat exchanger, comprising a housing, a first section maintained by the housing and having a first inlet and a first outlet, a second section maintained by the housing and having a second inlet and a second outlet, and at least one conductive plate extending between the first section and the second section, wherein the at least one conductive plate transfers heat from a fluid flowing in one of the sections to another fluid flowing in the other of the sections, wherein the sections are positioned such that the fluids' flow is non-intersecting.

Yet another aspect of the present invention is to provide a heat exchanger, comprising at least one temperature conductive plate, a first plate-fin configuration disposed adjacent a portion of the at least one temperature conductive plate and on one side thereof, a second plate-fin configuration disposed adjacent another portion of the at least one temperature conductive plate and on the one side, a separator bar disposed between the first and second plate-fin configurations and on the one side of the at least one temperature conductive plate.

BRIEF DESCRIPTION OF THE DRAWINGS

These and other features and advantages of the present invention will become better understood with regard to the following description, appended claims, and accompanying drawings wherein:

FIGS. 1A-1C are prior art plate-fin heat exchangers wherein FIG. 1A shows a perspective view of a counter-flow configuration, FIG. 1B shows a perspective and exploded view of a parallel flow configuration, and FIG. 1C shows a perspective and exploded view of a counterflow configuration;

BEST MODE FOR CARRYING OUT THE INVENTION

Figure 1A:
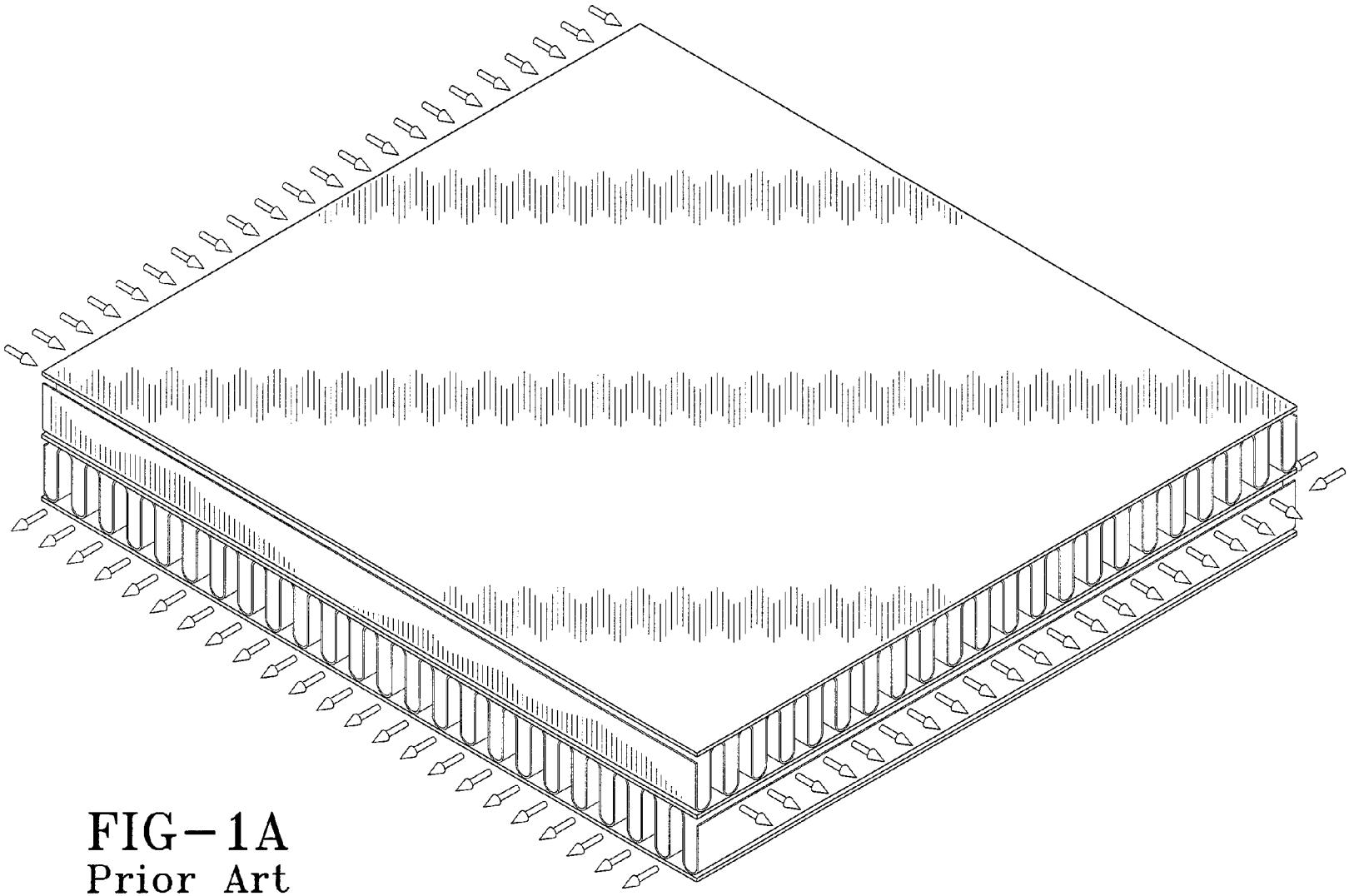
FIG-1A Prior Art
Figure 1B:
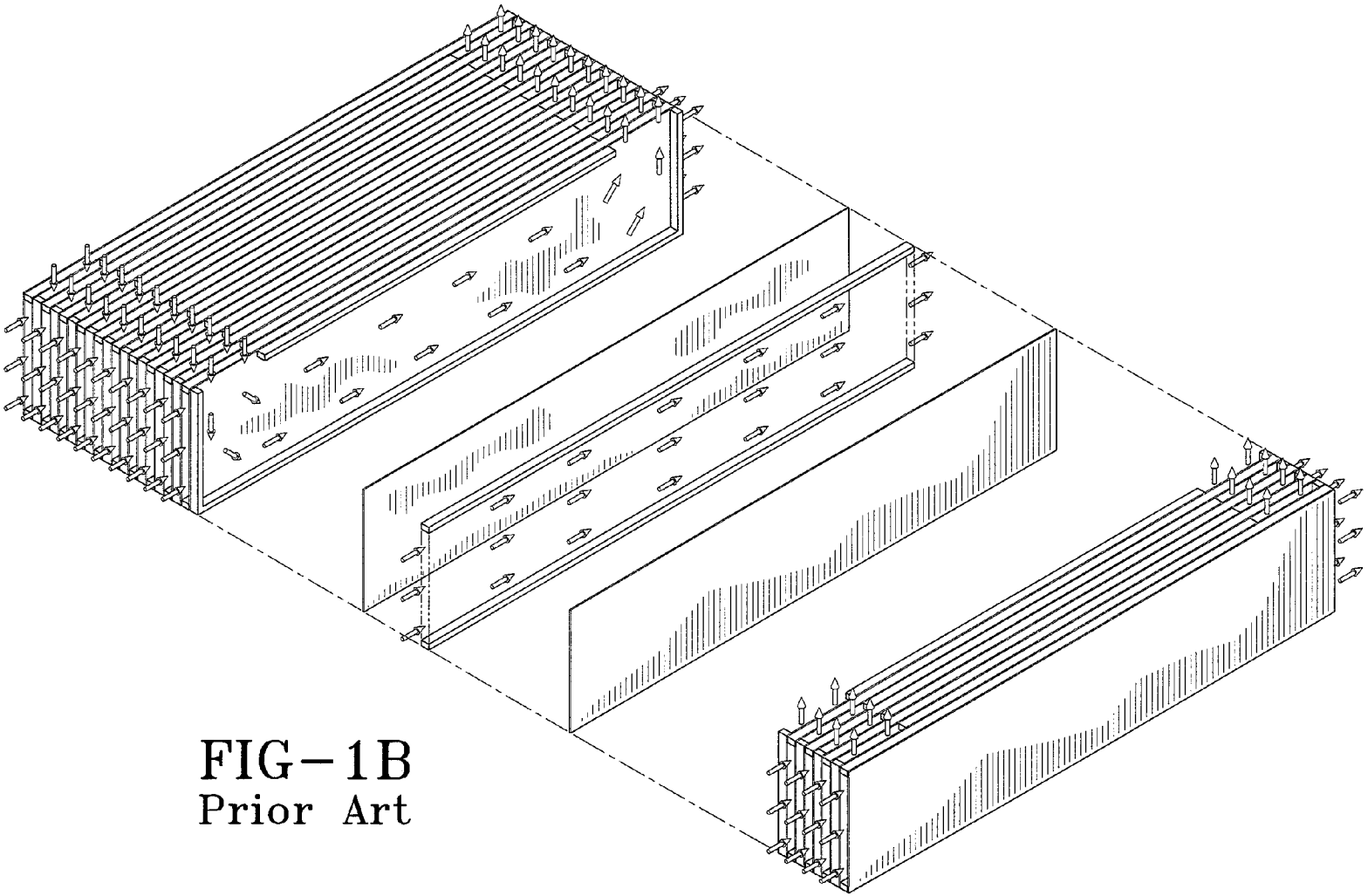
FIG-1B Prior Art
Figure 1C:
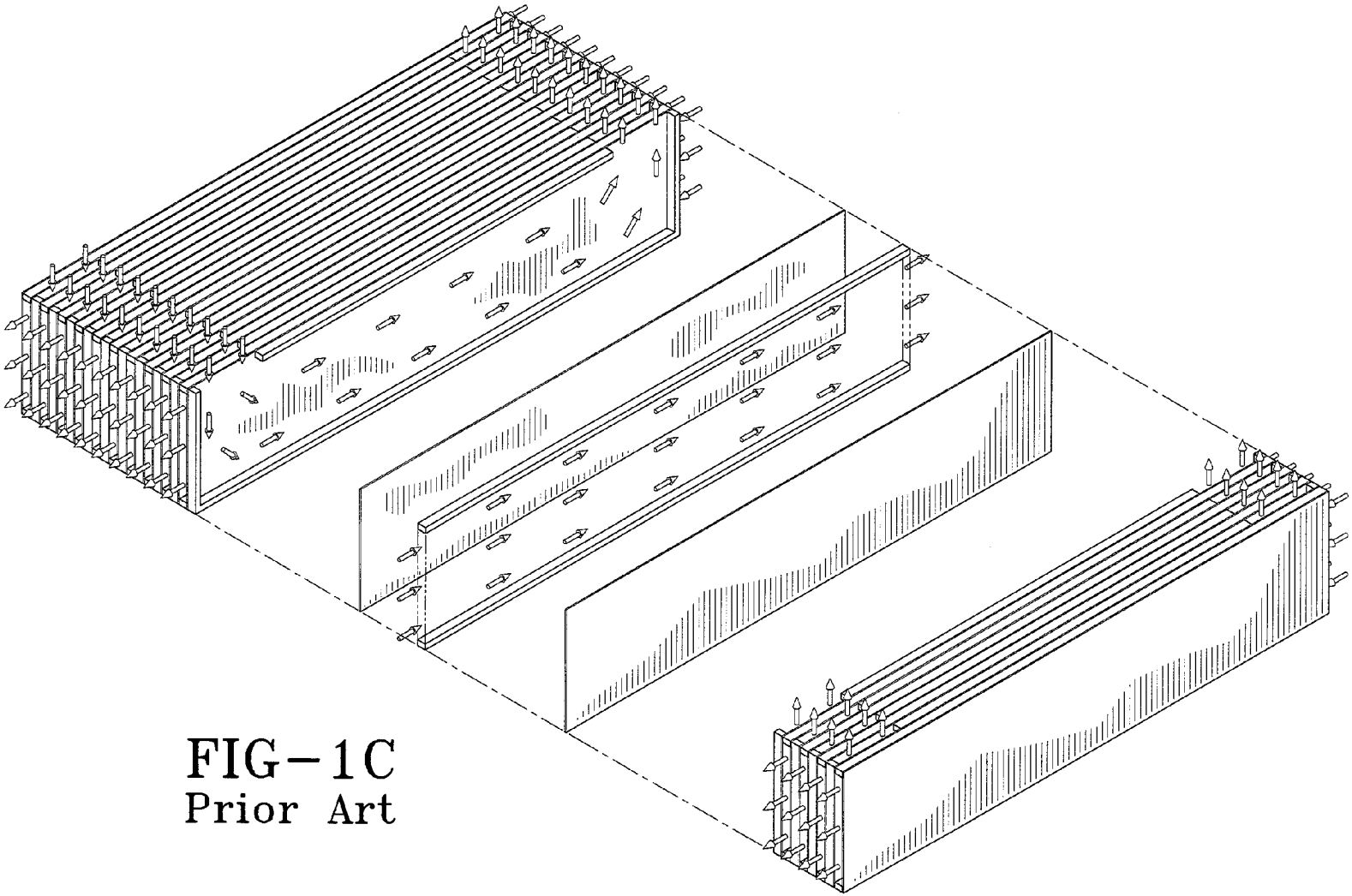
FIG-1C Prior Art
Figure 2:
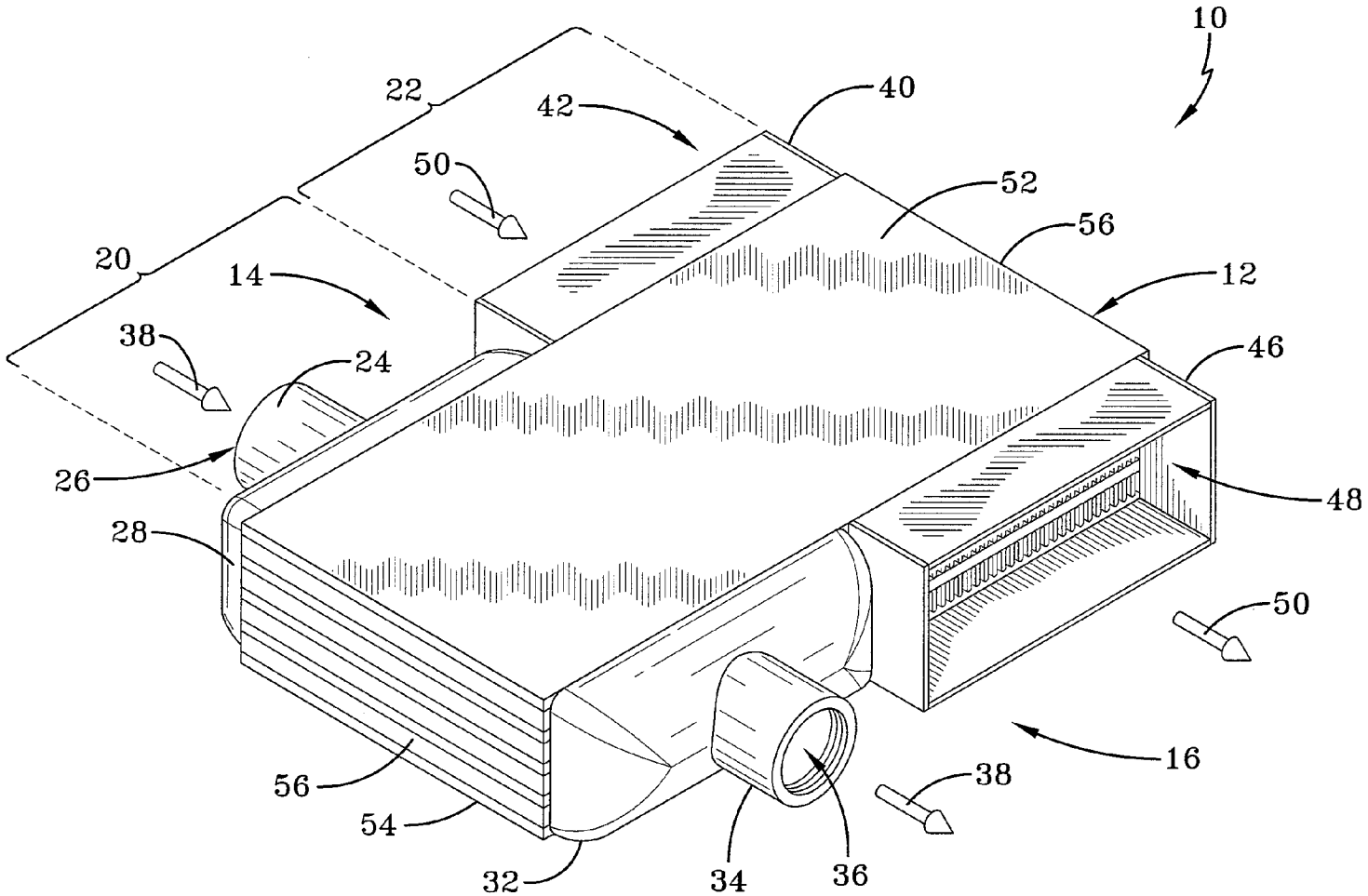
FIG. 2 is a perspective view of a heat exchanger made in accordance with the concepts of the present invention.
Figure 3:
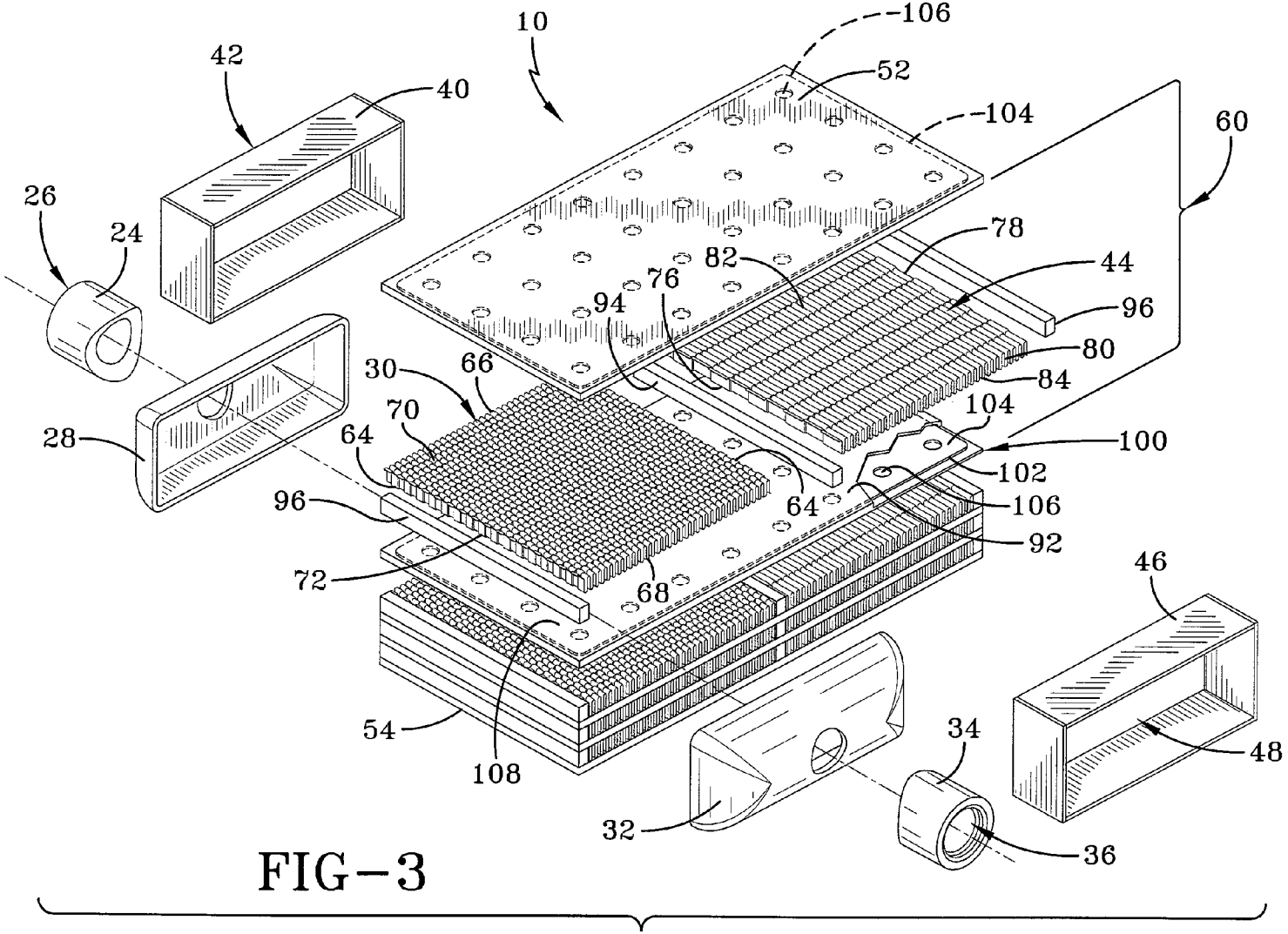
FIG. 3 is an exploded perspective view showing the heat exchanger of the present invention with a hyperconductive plate partially broken away.

Referring now to the drawings and in particular to FIGS. 2 and 3, it can be seen that a compact plate-fin heat exchanger is designated generally by the numeral 10. In the embodiment shown, the heat exchanger 10 provides two flow paths in parallel; however, the flow path could be counter-flow or, in other embodiments it is conceivable that multiple flows either in parallel or in a counter-flow arrangement could be provided. It will further be appreciated that the flow paths do not intersect or overlap with one another, are maintained in a coplanar or in some embodiments a co-curvilinear flow path, and as such do not cross-over one another. In other words, the planar flow of one fluid in one plane does not intersect with the planar flow adjacent the other flow path or paths in another plane. As used herein, plane or planar refers to a flat or level surface. Specifically, an area of a two-dimensional surface having determinate extension and spatial direction or position.

The heat exchanger 10 includes a housing 12 which provides an inlet side 14 and an outlet side 16. Of course, the inlet side and outlet side may be re-configured if a cross-flow heat exchanger is utilized. In any event, the housing 12 includes a first section 20 which handles a flow of fluid or material that is typically a high pressure flow and a second section 22 which handles a low pressure flow of fluid or material. The sections 20 and 22 are positioned side-by-side one another and do not overlap or are interleaved in any way which is common with the prior art heat exchanger configurations. As used herein, the term "fluid" means any liquid or gaseous material or combination thereof that moves through a container or series of containers under pressure or by other forces.

The first section 20 includes an inlet fitting 24 which may have internal threads. The fitting 24 provides an opening 26 therethrough and the fitting 24 is secured or connected to an inlet tank 28. As such, the fluid flowing through the first section is directed through the inlet fitting and into the tank 28. The tank 28 is secured to at least one plate-fin configuration designated generally by the numeral 30. The fluid material flows through the plate-fin configuration 30 and is collected by a header 32 on an opposite side of the inlet fitting. An outlet fitting 34 is connected to the header 32 and provides an opening 36 therethrough. The fitting 34 may also be provided with internal threads for connection to piping or conduits of a system associated with the heat exchanger. A high pressure flow of material represented by the arrow designated by the numeral 38 is directed into the inlet fitting 24 and through the plate-fin configuration 30 and then out the opening 36. The high pressure flow is considered a "high pressure" in relation to the flow maintained by the second section as will be described in detail later. However, it will be appreciated that equal pressure flows or even a low pressure flow may be directed through the first section in relative comparison to the flow of material or fluid through the second section. As used herein, low pressure may be quantified as 0-100 psia; medium pressure as 100-600 psia; and high pressure as 600-10,000 psia.

The second section 22 includes an inlet shroud 40 which provides a shroud opening 42. The shroud 40 is secured to at least one plate-fin configuration designated generally by the numeral 44 at one end and an outlet shroud 46 is connected to the plate-fin configuration 44 at an opposite end thereof The shroud 46 provides a shroud opening 48 therethrough. Accordingly, the second section 22 provides for a low pressure flow of fluid material through the housing. But, as previously mentioned, the flow of materials may be with equal pressures or in relative comparison, a high pressure flow if deemed appropriate.

The housing 12 includes a cover plate 52 positioned over the plate-fin configurations 30 and 44 and a cover plate 54 underneath the configurations. The housing further provides for sides 56 which interconnect the side edges of the cover plate 52 to the corresponding side edges of the cover plate 54. All together, the cover plates and sides, along with the respective inlets and outlets of the first and second sections form the housing 12.

An exploded perspective view of the heat exchanger 10 is shown. Specifically, FIG. 3 shows the internal components of the heat exchanger and the inclusion of at least one exchanger layer 60 which is maintained between the cover plates 52 and 54. It can be seen that the first section 20 and the exchanger layer 60 includes the high pressure plate-fin configuration 30. As one skilled in the art will appreciate, the plate-fin configuration 30 comprises layers of corrugated metallic sheets wherein the adjacent corrugations form openings so as to provide large amounts of surface area to absorb or emit the heat or relatively high temperature characteristic of a fluid passing therethrough as needed. The fins also increase the structural integrity of the configuration 30 and allow for the fluid to pass through the exchanger under relatively high pressure. It will further be appreciated that although a square or rectangular shape is provided for the plate-fin configuration 30, other shapes may be employed as deemed appropriate by the end use. Each configuration 30 provides for opposed side edges 64 and an inlet edge 64 opposite an outlet edge 68. The inlet edge 64 is positioned adjacent the inlet tank 28 whereas the outlet edge 68 is positioned to be adjacent the header 32. In some embodiments where a counterflow arrangement is employed, it will be appreciated that the inlet edge may be positioned on the opposite side or take the place of the outlet edge 68. The plate-fin configuration 30 also provides for a relative upper surface 70 opposite a lower surface 72. Of course the upper and lower surfaces may be switched as appreciated by a skilled artisan.

The second section 22 is constructed in much the same manner as the first section. Specifically, the second section 22 includes the exchanger layer 60 and the lower pressure plate-fin configuration 44 which is the same or different than the high pressure configuration. In the low pressure plate-fin configuration, the fins may be shaped in a somewhat different manner so as to accommodate the fluid or material flowing therethrough. In any event, the plate-fin configuration 44 includes opposed side edges 76 and an inlet edge 78 opposite an outlet edge 80. The inlet edge 78 is positioned to be proximal the inlet shroud 40 while the outlet edge 80 is positioned proximally the outlet shroud 46. The plate-fin configuration 44 also provides for a relative upper surface 82 opposite a lower surface 84.

The exchanger layer 60 further includes an upper foil sheet 90 which spans both sections and is in contact with or proximal both upper surfaces 70 and 82 of the respective plate-fin configurations. Likewise, a lower foil sheet 92 is disposed adjacent the lower surfaces 72 and 84 and spans both sections and is in contact with or proximally adjacent the lower surfaces of the plate-fin configurations. The foil sheets are constructed from a metallic material such as aluminum and any related alloys. Of course, other metallic materials and their alloys could be used. The sheets are constructed to be amenable to brazing processes which allow for integral connection to the other components of the housing. Further included in the exchanger layer is a divider bar 94 which separates the first section from the second section and specifically the plate-fin configurations from each other and is of substantially the same thickness as both plate-fin configurations. The bar 94 is positioned close to or adjacent their respective interior or side edges 64 and 76 of each pate-fin configuration. Positioned along the outer edges of each side edge 64 are end bars 96. In other words, one end bar 96 is positioned on the exterior facing side edge 64 of the first plate-fin configuration 30 and a second end bar 96 is positioned on the exterior facing side edge 78 of the second plate-fin configuration 44. The end bars are of substantially the same height as the divider bar 94 and are likewise substantially the same height as the plate-fin configurations 30 and 44.

The exchanger layer 60 further includes a hyperconductive plate 100 which is disposed under the lower foil sheet 92 and spans both the first and second sections and is positioned in close proximity to both plate-fin configurations 30 and 44. The hyperconductive plate 100 transfers by thermal conduction the heat in one fluid passing through one section to the fluid passing through the other section. As the temperature of one fluid is reduced, the temperature of the other fluid is increased by virtue of the thermal conduction.

In summary, the exchanger layer 60 includes, at a minimum, the foil separator sheet 90, the two plate-fin configurations 30 and 44, and the lower foil sheet 92. Also included in the exchanger layer is the hyperconductive plate 100, the end bars 96 and the divider bar 94. An additional foil sheet may be interposed between the cover plate 52 and the adjacent hyper conductive plate 100. And it will further be appreciated that the cover plates 52 and 54 may be substituted with hyperconductive plates 100.

Figure 4:
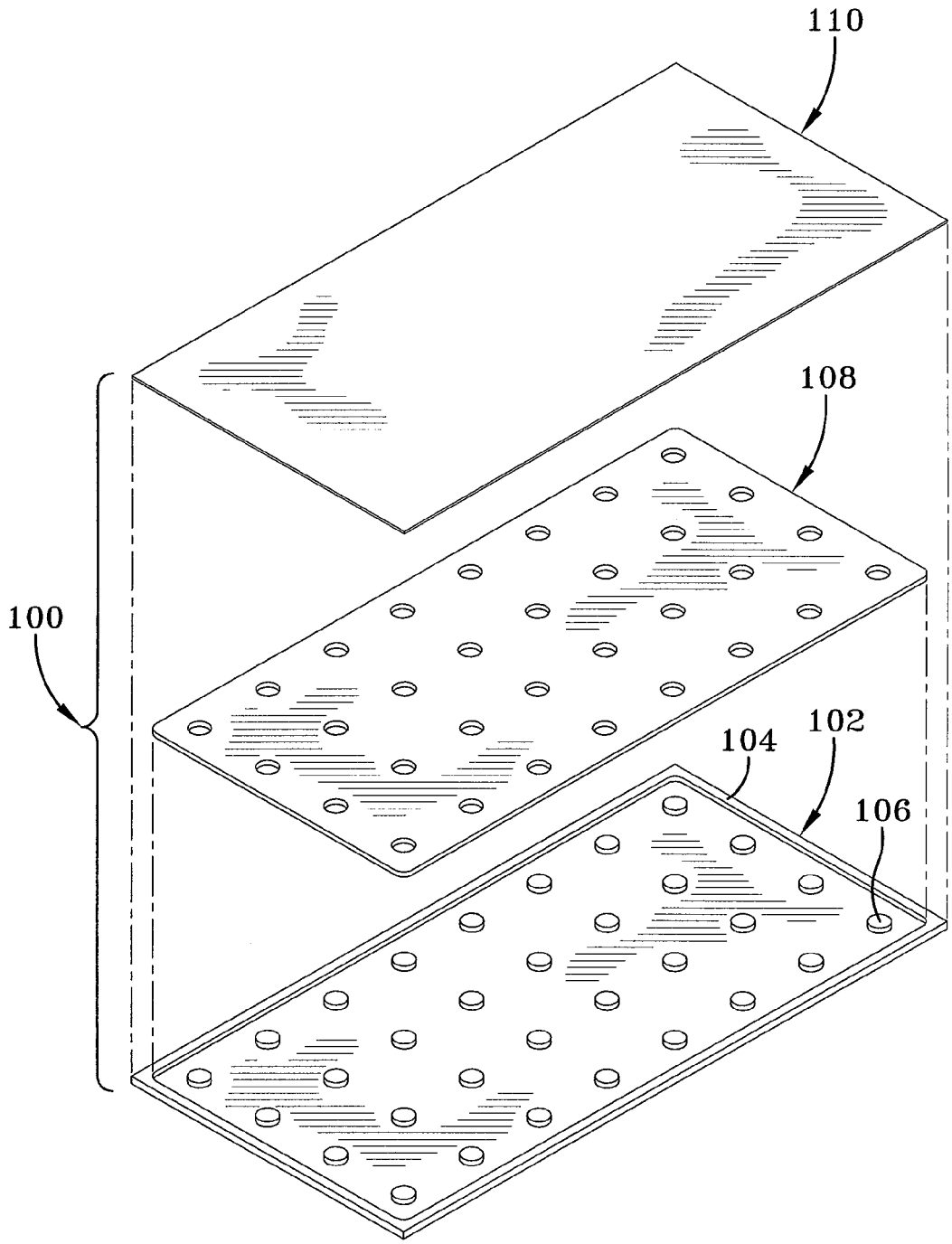
FIG. 4 is an exploded perspective view of the hyperconductive plate made in accordance with the concepts of the present invention.
Figure 5:
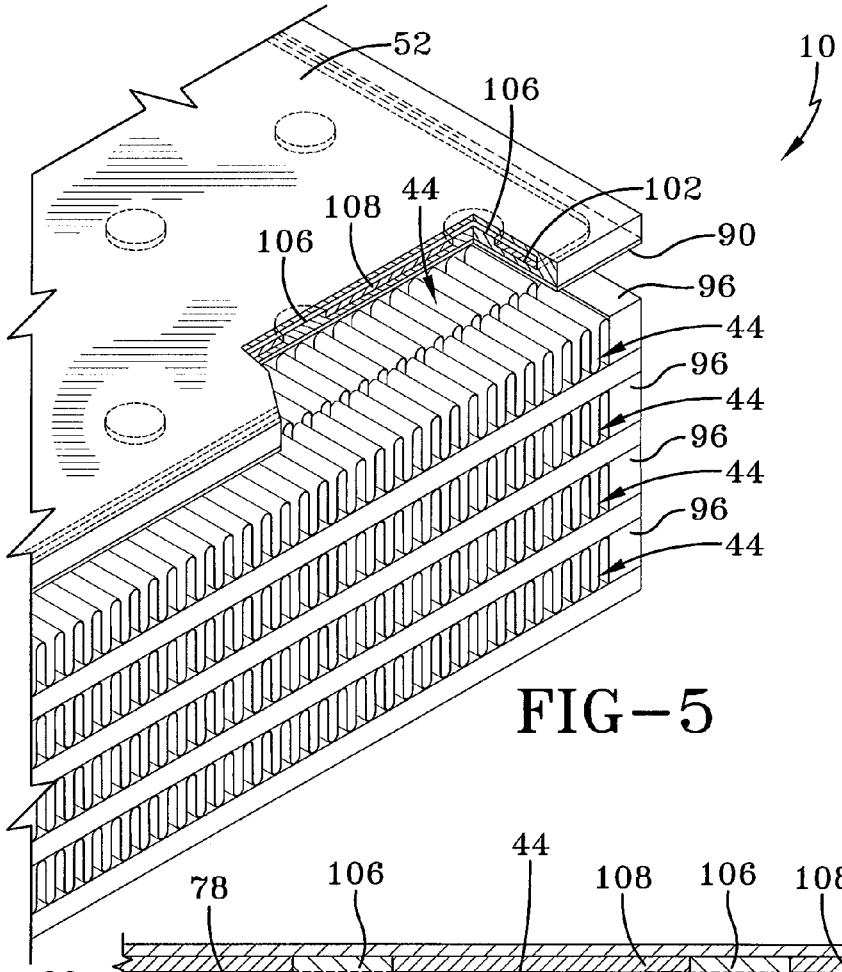
FIG. 5 is a detailed view of the hyperconductive plate utilized in the exchanger layer in accordance with the concepts of the present invention.
Figure 6:
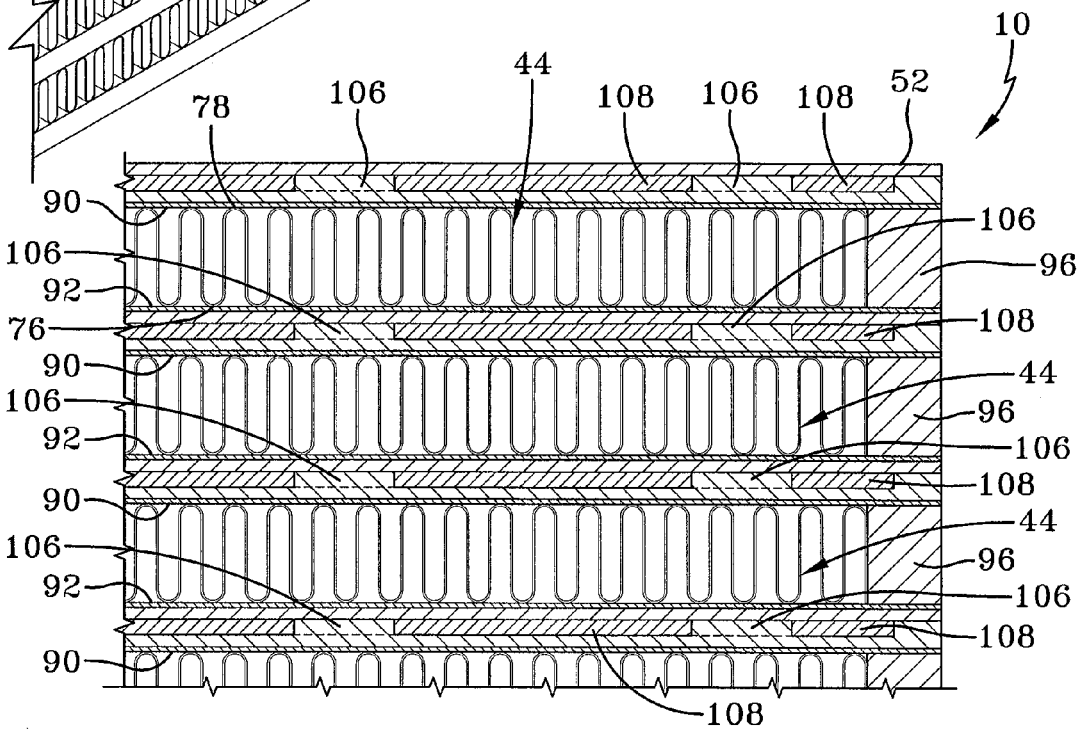
FIG. 6 is a detailed partial cross-sectional view of plate-fin configurations in contact with the hyperconductive plate shown in FIG. 5 and in accordance with the concepts of the present invention.

Referring to FIG. 3, and as best seen in FIG. 4, the hyperconductive plate 100 comprises a three-layer construction that is separately formed and then incorporated into the heat exchanger 10. The plate 100 includes a baseplate 102 having a perpendicularly extending outer rim 104 about the outer periphery of the baseplate 102 and a plurality of outwardly extending integral buttons 106. The buttons 106 may be configured in any number of patterns and in the embodiment shown the buttons are in a uniformly spaced 4×8 matrix configuration. The baseplate and buttons are of aluminum construction but other materials could be used. The baseplate is filled up to the outer rim 104 with a graphite-based hyperconductive material 108, wherein a top surface of each button, which are at the same height as the rim 104, remains exposed. A cover plate 110 is disposed over the rim 104 and the buttons 106 and fused along all of the contact faces or exposed surfaces—the rim and the buttons—using a high pressure, high temperature diffusion bonding process. Upon completion of the process the baseplate 102 and the cover plate 100 become like one solid piece of aluminum. Skilled artisans will appreciate that the hyperconductive material 108 transfers heat only in the plane of the plate 100, and that the material functions as an insulator perpendicular to the plane of the plate. In other words, the heat migrates laterally along the plane but not across the plane. As a result, with the buttons integral with both the baseplate 102 and the cover plate 110, the buttons 106 function as "vias" to conduct or transfer heat from the adjacent layers into the material 108 whereupon the heat transfers or migrates to areas of the graphite-based material which has a relatively lower temperature. In some embodiments, the hyperconductive plate 100 could be disposed between the cover plates and the adjacent foil sheet.

In most embodiments, the exchanger 10 shown in FIGS. 2 and 3 is assembled by a brazing process. In other words, the exchanger layers and cover plates are assembled and clamped to one another. The clamped assembly is placed in an oven or other controlled heating environment and heated to a predetermined temperature in an appropriate heating and cooling cycle so as to form an integral unit. During the brazing process the foil sheets become integral with the adjacent surfaces of the hyperconductive plate, the plate-fin configurations and the bars. The outlet/inlet connections are welded or also brazed to the assembled layers.

In operation, one fluid material flows in through the first high pressure section 20 and enters the inlet and the inlet edges of the single or multiple layers of the plate-fin configurations 30. The heat contained in the fluid is absorbed and transferred, by conduction, from the plate-fins to the contacting foil layers 90 and 92 and, in turn, to the buttons 106 maintained by the adjacent hyperconductive plates 100. The heat absorbed by the buttons 106 is then laterally transferred to the adjacent graphite material which absorbs the heat and laterally transfers the heat along the plane of the material. The heat is then conducted or transferred into the buttons 106 located in the second section 22 where the heat is then transferred to the adjacent plate-fin configuration 44 whereupon it is absorbed by the fluid material passing therethrough. By maintaining fluid flows in side-by-side or non-intersecting sections, the fluid flows through the housing is coplanar and non-intersecting. In some embodiments it will be appreciated that the sections and their constituent parts may be provided in a curvilinear construction. As such, the flow of fluids through such a heat exchanger would be co-curvilinear and non-intersecting. The co-curvilinear features of exchanger layers could be derived utilizing a spherical coordinate system or in any other three-dimensional coordinate system. In other embodiments it will be appreciated that the flow paths are not coplanar or co-curvilinear but still non-intersecting. In such an embodiment similar to the one shown in FIG. 2, the first and second sections could be disposed or oriented at an angle other than zero degrees with respect to one another. Such an embodiment would necessitate the "bending" of the hyperconductive plate(s) and possibly the plate-fin configuration in one or both sections. Additionally, the dimensions of the plate-fin configurations of each layer may be sized to accommodate the angular orientation of the sections.

Skilled artisans will appreciate that the plate-fin configurations are only adjacent or side-by-side one another at the interior facing side edges and, as such, there is no overlap or intersecting of the fluid flow along the major dimension of the fluid's plane or at the upper or lower surfaces of the plate-fin configurations. Since there is no overlapping or interleaving of the plate-fin configurations, the chance for cross-contamination of the fluids passing through the first and second sections is greatly minimized. The hyperconductive plate and separation bars are secured to one another by the brazing process and as such function to keep the flow paths isolated from one another while still allowing a desired heat transfer between the fluid materials. It will further be appreciated that the plate-fin configurations are stacked in their respective sections and positioned in non-interleaving arrangement so as to improve the flow characteristics of both materials. As a result, both materials can be transmitted through the heat exchanger at higher pressures than in prior art configurations which improves the overall throughput of the heat exchange system. It will further be appreciated that the configuration shown in FIGS. 2 and 3 allows for the flow paths to be run in parallel or in a counter-flow arrangement where one of the flow paths is reversed. Still another advantage of the present invention is that it decreases the pressure losses associated with heat transfer. This feature allows for increased optimization of pressure losses to increase heat transfer and flow in applications highly sensitive to pressure loss due to design or system constraints. Still yet another advantage of the present invention is that it allows for a smaller heat exchanger profile to be configured while providing the same heat transfer characteristics.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A heat exchanger, comprising:

a housing;

a first section having a first plate-fin configuration maintained by said housing and having a first inlet and a first outlet;

a second section having a second plate-fin configuration maintained by said housing and having a second inlet and a second outlet; and a plurality of heat exchanger layers, wherein each said heat exchanger layer comprises at least one conductive plate extending between said first section and said second section and positioned in proximity to said first and second plate-fin configurations, wherein said at least one conductive plate has internally disposed integral buttons that are in a contacting relationship with said first and second plate-fin configurations, and wherein said buttons are surrounded by a graphite-based heat transferring material, wherein each said heat exchanger layer transfers heat from a fluid flowing in one of said sections to another fluid flowing in the other of said sections, and wherein said sections are positioned such that the fluids' flow is non-intersecting.

2. The heat exchanger according to claim 1, wherein said respective inlets are substantially opposite said outlets.

3. The heat exchanger according to claim 1, wherein the fluids' flow is coplanar or co-curvilinear.

4. The heat exchanger according to claim 1, further comprising:

a divider bar disposed between each of said first and second plate-fin configurations positioned side-by-side.

5. The heat exchanger according to claim 4, wherein said heat exchanger layer further comprises a foil sheet disposed on each upper and lower surfaces of said first and second plate-fin configurations.

6. A heat exchanger, comprising:

at least one temperature conductive plate;

a first plate-fin configuration disposed adjacent a portion of said at least one temperature conductive plate and on one side thereof;

a second plate-fin configuration disposed adjacent another portion of said at least one temperature conductive plate and on said one side;

a separator bar disposed between said first and second plate-fin configurations and on said one side of said at least one temperature conductive plate; and a pair of foil separator sheets, wherein a foil separator sheet is disposed on each side of said at least one temperature conductive plate so that said first and second plate-fin configurations and said separator bar are on a side of one of said pair of foil separator sheets opposite said at least one temperature conductive plate, and wherein said at least one temperature conductive plate has internally disposed integral buttons surrounded by a graphite-based heat transferring material that are in a contacting relationship with said first and second plate-fin configurations.

7. The heat exchanger according to claim 6, wherein said pair of foil separator sheets, said first and second plate-fin configurations with said separator bar therebetween, and said temperature conductive plate collectively form an exchanger layer, and wherein the heat exchanger comprises a plurality of said exchanger layers.

8. The heat exchanger according to claim 7, wherein each of said first plate-fin configurations have a first inlet on one side and a first outlet on an opposite side, and wherein said second plate-fin configurations have a second inlet on one side and a second outlet on an opposite side.

9. The heat exchanger according to claim 8, wherein a fluid flows into said first inlet and out said first outlet and another fluid flows into said second inlet and out said second outlet so that said exchanger layers transfer heat between said fluid and said another fluid.

10. The heat exchanger according to claim 9, wherein said fluid flows are non-intersecting.

11. The heat exchanger according to claim 9, wherein said fluid flows through said exchanger layers is either coplanar or co-curvilinear.

* * * * *